US008858292B2

(12) United States Patent
Liao

(10) Patent No.: US 8,858,292 B2
(45) Date of Patent: Oct. 14, 2014

(54) TUMBLING TOY AND ITS ASSOCIATED METHOD OF MANUFACTURE

(76) Inventor: Chu-Yuan Liao, Taipei (TW)

( * ) Notice: Subject to any disclaimer, the term of this patent is extended or adjusted under 35 U.S.C. 154(b) by 177 days.

(21) Appl. No.: 13/479,581

(22) Filed: May 24, 2012

(65) Prior Publication Data

US 2013/0316612 A1 Nov. 28, 2013

(51) Int. Cl.
*A63H 11/08* (2006.01)

(52) U.S. Cl.
USPC ..... 446/324

(58) Field of Classification Search
USPC ..... 446/256, 259, 324
See application file for complete search history.

(56) References Cited

U.S. PATENT DOCUMENTS

| | | | | | |
|---|---|---|---|---|---|
| 1,214,454 | A | * | 1/1917 | Gowdey | 446/324 |
| 1,254,428 | A | | 1/1918 | Myers | |
| 1,272,588 | A | * | 7/1918 | White | 446/324 |
| 1,494,963 | A | * | 5/1924 | Smith | 446/431 |
| 2,218,207 | A | * | 10/1940 | Herzinger | 446/324 |
| 2,585,780 | A | * | 2/1952 | Johnson | 446/396 |
| 2,751,707 | A | * | 6/1956 | Kask | 446/324 |
| 3,073,598 | A | * | 1/1963 | Tiikkainen | 273/341.1 |
| 3,519,273 | A | * | 7/1970 | Viby | 473/594 |
| 4,213,266 | A | | 7/1980 | Hyland et al. | |
| 4,238,904 | A | * | 12/1980 | Lang | 446/168 |
| 4,314,422 | A | * | 2/1982 | Wexler | 446/269 |
| 4,952,191 | A | * | 8/1990 | Martinez | 446/324 |
| 5,575,702 | A | | 11/1996 | Silvious | |
| 5,928,055 | A | * | 7/1999 | Gramsch | 446/324 |

* cited by examiner

*Primary Examiner* — Kurt Fernstrom
(74) *Attorney, Agent, or Firm* — LaMorte & Associates, P.C.

(57) ABSTRACT

A tumbling toy assembly that spins on a flat surface and tumbles down an inclined surface. The toy assembly has a body. A fulcrum protrusion extends downwardly from the bottom of the body. The fulcrum protrusion is aligned on an imaginary spin axis. This enables the body to spin in a stable manner upon the fulcrum protrusion. Furthermore, the body defines an internal weight chamber having a first end and an opposite second end that are aligned with the imaginary spin axis. A weight is disposed within the weight chamber. The weight is free to move between the first end and the second end of the weight chamber along the imaginary spin axis. Protrusions extend outwardly from the body. The protrusions cause deviations in the direction of tumble as the tumbling toy assembly tumbles down an inclined plane.

17 Claims, 7 Drawing Sheets

TUMBLING TOY AND ITS ASSOCIATED METHOD OF MANUFACTURE

BACKGROUND OF THE INVENTION

1. Field of the Invention

In general, the present invention relates to toys that roll or tumble down inclined planes. More particularly, the present invention relates to toys that have a variable center of gravity that changes as a function of the orientation of the toy.

2. Prior Art Description

Tumbling toys have been sold by toy manufacturers for over a century. Tumbling toys have hollow internal compartments. A free weight is placed in the internal compartment that is much smaller than the compartment. When the tumbling toy is placed on an inclined surface, the weight moves to the lowest part of the internal chamber. This changes the center of gravity for the toy and the toy tumbles over. Once the toy tumbles, the weight is now at the top of the internal chamber and the cycle repeats. The result is a toy that continues to tumble down an inclined plane until the toy comes to rest on a flat surface. Such prior art tumbling toys are exemplified by U.S. Pat. No. 1,254,428 to Myers, entitled Tumbling Toy; U.S. Pat. No. 4,213,266 to Hyland, entitled Tumbling Toy; and U.S. Pat. No. 5,575,702 to Silvious, entitled Telescoping Tumbling Toy.

Prior art tumbling toys tend to tumble in a straight line. Furthermore, prior art tumbling toys tend to tumble in only one direction as they tumble or roll down an inclined surface. The applicant has discovered that the play value of a tumbling toy can be dramatically increased by making a toy that randomly tumbles down an inclined surface without following a straight line. The play value of a tumbling toy is also increased by making a tumbling toy that randomly reverses direction as it tumbles, therein sometimes tumbling face forward and sometimes tumbling back forward during the same tumble run. The details of the present invention that allow for these improved characteristics are described and claimed below.

SUMMARY OF THE INVENTION

The present invention is a tumbling toy assembly that spins on a flat surface and tumbles down an inclined surface under the force of gravity. The toy assembly has a body. A fulcrum protrusion extends downwardly from the bottom of the body. The fulcrum protrusion is aligned on an imaginary spin axis, wherein the body is balanced about the imaginary spin axis. This enables the body to spin in a stable manner upon the fulcrum protrusion. Furthermore, the body defines an internal weight chamber having a first end and an opposite second end that are aligned with the imaginary spin axis.

A weight is disposed within the weight chamber. The weight is free to move between the first end and the second end of the weight chamber along the imaginary spin axis.

A plurality of protrusions extend outwardly from the body. The protrusions cause deviations in the direction of tumble as the tumbling toy assembly tumbles down an inclined plane. The tumbling path of the tumbling toy assembly, therefore, becomes erratic and contains multiple changes in direction during a tumbling run. This increases the novelty and play value of the tumbling toy assembly.

BRIEF DESCRIPTION OF THE DRAWINGS

For a better understanding of the present invention, reference is made to the following description of exemplary embodiments thereof, considered in conjunction with the accompanying drawings, in which.

DETAILED DESCRIPTION OF THE DRAWINGS

Although the present invention toy assembly can be embodied in many ways, the embodiments illustrated show the toy assembly externally configured as a character having both arms and legs. This embodiment was selected in order to set forth one of the best modes contemplated for the invention. The illustrated embodiments, however, are merely exemplary and should not be considered a limitation when interpreting the scope of the appended claims.

Figure 1:
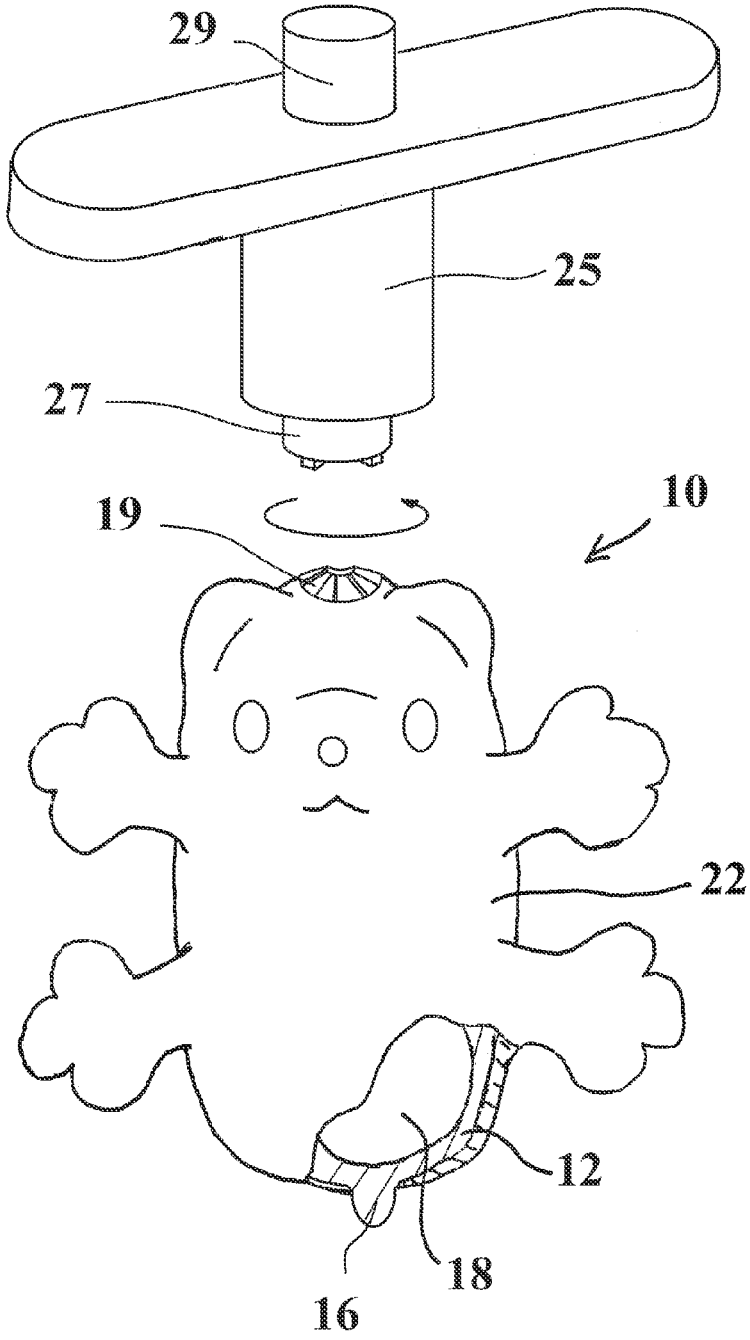
FIG. 1 is a front view of an exemplary embodiment of a tumbling toy assembly.
Figure 2:
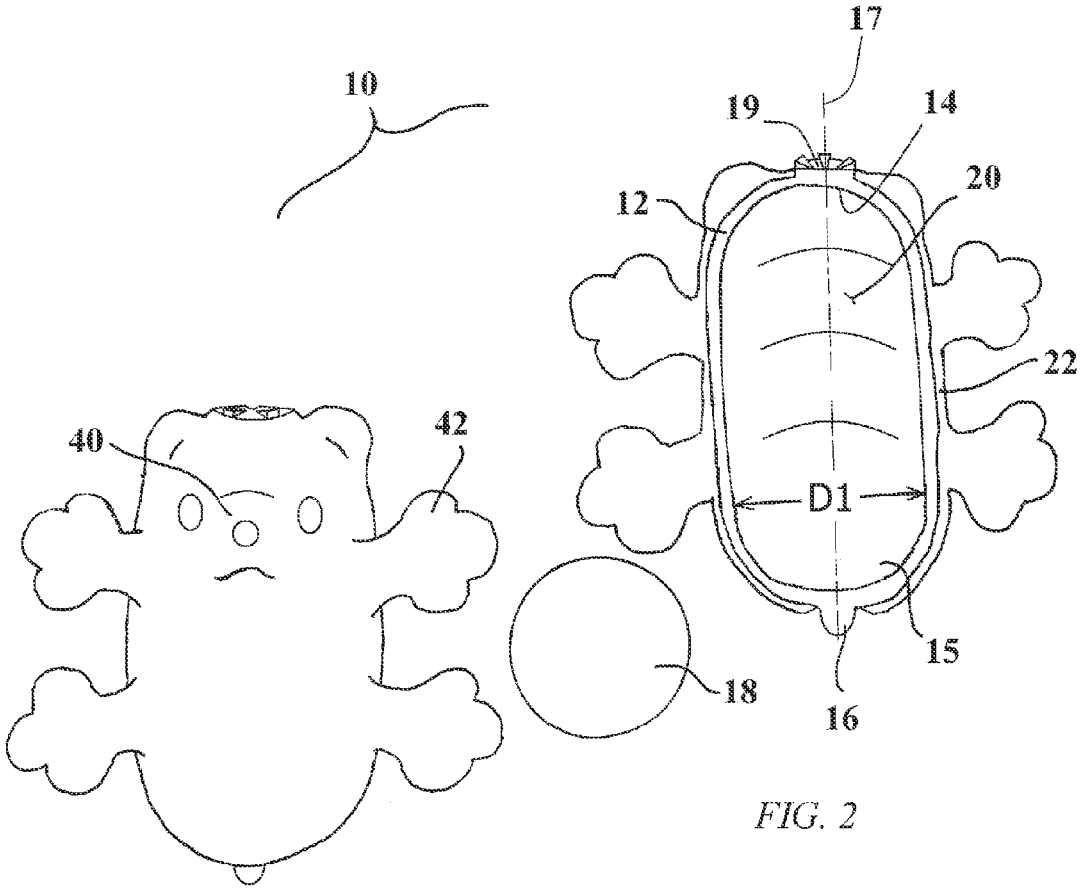
FIG. 2 is an exploded view of the embodiment of FIG. 1.

Referring to FIG. 1 and FIG. 2, it can be seen that the tumbling toy assembly 10 has a body 11. The body 11 is comprised, in part, of a plastic capsule 12. The plastic capsule 12 is elongated and defines an internal chamber 20 that has a uniform diameter D1 between two ends 14, 15. The plastic capsule 12 is made of a traditional rigid plastic, such as polypropylene, PETE, HDPE or even PVC.

A fulcrum protrusion 16 extends downwardly from the bottom center of the plastic capsule 12. The fulcrum projection 16 is the lowest part of the tumbling toy assembly 10. Likewise a spin connector 19 extends upwardly from the top of the plastic capsule 12. Both the fulcrum projection 16 and the spin connector 19 are vertically aligned with the center of gravity for the tumbling toy assembly 10 along spin axis 17. In this manner, the tumbling toy assembly 10 is capable of spinning upon the fulcrum projection 16 in the manner of a toy top.

A weight 18 is placed inside the internal chamber 20. The weight 18 is preferably rounded and has an outside diameter only slightly smaller than the inside diameter D1 of the internal chamber 20. The length of the capsule 12 and its internal chamber 20 is preferably at least three times as long as the diameter of the weight 18. As a result, the weight 18 is free to roll inside the capsule 12 in a linear path from one end 14 of the capsule 12 to the other end 15. Both the weight 18 and the internal chamber 20 are centered about the spin axis 17. Consequently, the weight 18 remains balanced about the spin axis 17 even when the weight 18 rolls within the internal chamber 20.

Most of the plastic capsule 12 is enveloped in a molded shell 22 of elastomeric material 24 such as a thermo plastic rubber (TPR) or a styrene-based block copolymer. Only the fulcrum protrusion 16 and the spin connector 19 remain uncovered. The shell 22 is molded around the capsule 12 and the elastomeric material 24 is heat bonded to the rigid plastic of the capsule's exterior. This prevents a child from attempting to peel the molded shell 22 away from the internal plastic capsule 12.

The molded shell 22 is thin in most areas. In areas where the molded shell 22 conforms to the shape of the inner plastic capsule 12, the molded shell 22 is a thin skin of no more than two millimeters thick. This minimizes the amount of elastomeric material 24 required to manufacture the tumbling toy assembly 10 and therefore reduces manufacturing costs.

Figure 3:
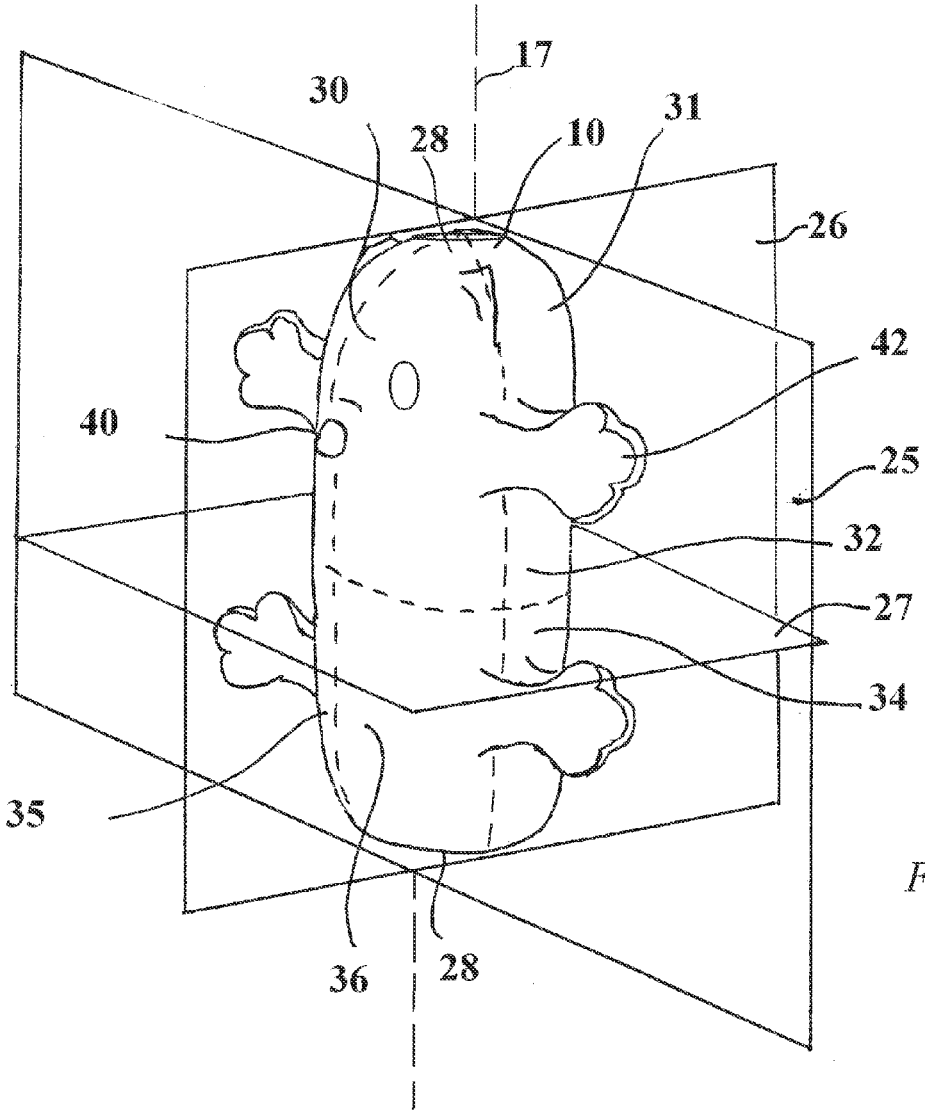
FIG. 3 is a perspective view of the embodiment of FIG. 1, shown with bisection reference planes.

The exterior of the molded shell 22 does have thicker features that are molded and decorated to form a character or an object. Referring to FIG. 3, an image of the exemplary tumbling toy 10 is shown bisected by three imaginary planes 25, 26, 27 that extend in the illustrated X-axis, Y-axis and Z-axis respectively. The three planes 25, 26, 27 intersect at perpendiculars at the center of the tumbling toy assembly 10. The tumbling toy assembly 10 has a face section 30, a rear section 31, a top section 32, a bottom section 34 and two side sections 35, 36. The top section 32 and the bottom section 34 are the sections above and below the Z-axis plane 27. The top end 28 and the bottom end 29 of the tumbling toy assembly 10 keep the spin connector 19 and the fulcrum protrusion 16, respectively. The face section 30 of the toy tumbling assembly 30 is the section on the front side of the imaginary X-axis plane 25. Conversely, the rear section 31 of the tumbling toy assembly 10 is considered the section on the far side of the imaginary X-axis plane 25. The two side sections 35, 36 of the toy tumbling assembly 10 should be considered the sections to the left and to the right of the imaginary Y-axis plane 26.

Small protrusions 40, in the form of ears, tails, hands, noses and the like can be molded onto the face and rear sections 30, 31 of the tumbling toy assembly 10. The small protrusions 40 are off set from the X-axis plane 25 and may even be aligned on the Y-axis plane 26. The small protrusions 40 extend no more than five millimeters from the plastic capsule 12. The small protrusions 40 cause the tumbling toy assembly 10 to experience small deviations as it tumbles. For example, if the tumbling toy assembly 10 rolls onto one of the small protrusions 40, the tumbling toy assembly 10 can tumble to the left or to the right of that protrusion. The direction of tumble is subject to many random variables, such as toy orientation, tumble speed and the like. Consequently, the tumble toy assembly 10 will not tumble in the exact same manner each time it tumbles. The small protrusions 40 are preferably evenly distributed about the spin axis 17 so as to not cause the tumbling toy assembly 10 to become unstable when it spins upon the fulcrum protrusion 16.

Large protrusions 42 extend from the side sections 35, 36 of the tumbling toy assembly 10. The large protrusions 42 are aligned, or nearly aligned, with the X-axis plane 25. The large protrusions 42 are provided in sets of two, wherein each large protrusion 42 extends 180 degrees opposite the other. Although one set of large protrusions 42 can be used, it is preferred that two sets be provided. One set of large protrusions 42 is positioned above the Z-axis plane 27 and the other below. The large protrusions 42 are preferably evenly distributed about the spin axis 17 so as to not cause the tumbling toy assembly 10 to become unstable when it spins upon the fulcrum protrusion 16.

The large protrusions 42 extend at least one centimeter from the inner plastic capsule 12. The large protrusions 42 are molded as arms, legs, horns or any other feature that fits the motif of the overall tumbling toy assembly 10. The large protrusions 42 are also large enough to sometimes reverse the direction of tumble, depending upon other circumstances and conditions.

Returning to FIG. 1, it can be seen that the tumbling toy assembly 10 is designed to be engaged with a spring loaded launcher 25. The spring loaded launcher 25 has an end connector 27 that engages the spin connector 19 at the top of the toy tumbling assembly 10. The spring loaded launcher 25 contains an internal spring that stores rotational energy when the end connector 27 is wound. The rotational energy is released when an activation button 29 atop the spring loaded launcher 25 is pressed.

The spin connector 19 on the toy tumbler assembly 10 temporarily interconnects with the end connector 19 of the spring loaded launcher 25. Once interconnected, the toy tumbler assembly 10 is rotated. This winds the spring within the spring loaded launcher 27. Once the spring loaded launcher 25 is wound, the energy in the spring is released by pressing the activation button 29. Once the spring energy is released, the end connector 27 rapidly spins in the direction opposite the direction of the wining. This rotational energy is transferred to the toy tumbling assembly 10, wherein the toy tumbler assembly 10 spins rapidly around its spin axis 17. The toy tumbling assembly 17 then automatically disconnects from the spring loaded launcher 25 and falls away. If spinning with enough rotational speed, the toy tumbling assembly 10 will spin like a top upon its fulcrum protrusion 16. The toy tumbling assembly 10 will continue to spin upon the fulcrum protrusion 16 until its rotational energy dissipates.

Figure 4:
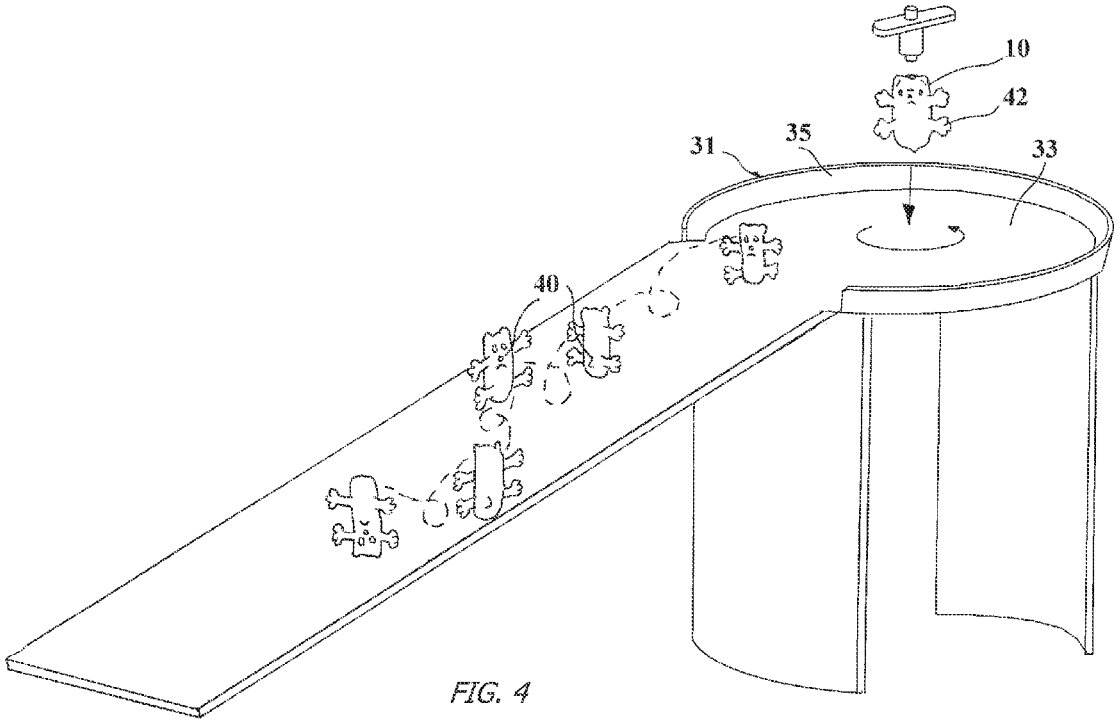
FIG. 4 is an image of the exemplary embodiment of the tumbling toy assembly tumbling down an inclined plane on a play set.

Referring to FIG. 4, a play platform 31 is shown. The play platform 31 includes a horizontal arena 33. An inclined surface 44 leads away from part of the horizontal arena 33. The horizontal area 33 is surrounded by a wall 35 that prevents a toy tumbling assembly 10 from falling off of the sides of the horizontal arena 33. However, the wall 35 does not block access to the inclined surface 44 from the horizontal arena 33. Consequently, a toy tumbling assembly 10 can move from the horizontal arena 33 to the inclined plane 44 in an unobstructed manner.

Using the spring loaded launching device 25, a toy tumbling assembly 10 is set spinning about its spin axis upon the horizontal arena 33. If the spinning toy tumbling assembly 10 moves to the inclined surface 44, the toy tumbling assembly 10 will begin to tumble. As the toy tumbling assembly 10 starts to tumble, it may also be spinning. However, when tumbling, the large projections 42 will strike the inclined surface 44 and stop or significantly slow any rotation. Once spinning stops, the toy tumbling device 10 loses any gyroscopic stability and begins to tumble.

If the tumbling toy assembly 10 is tumbling in a first direction down an inclined surface 44, variations created by tumbling over the small protrusions 40 may cause the tumbling toy assembly 10 to begin to turn sideways. As the tumbling toy assembly 10 turns sideways, the tumbling toy assembly 10 will attempt to tumble over the large protrusions 42. If the tumbling toy assembly 10 does not have enough momentum to tumble over the large protrusions 42, it will no longer tumble sideways. Rather, the path of least resistance will be toward the face section 30 where there are no large protrusions 42. Consequently, the tumbling toy assembly 10 stops tumbling in the first direction and begins to tumble in a new second direction. As a result, due to the presence of the small protrusions 40 and the large protrusions 42, the tumbling toy assembly 10 may change its direction of tumble multiple times as it tumbles down an inclined surface 44.

The large protrusions 42 are made from the same elastomeric material as the rest of the outer shell 22. It will therefore be understood that the large protrusions 42 are soft. Consequently, the large protrusions 42 may yield and spring back as they are contacted during a tumble. This adds to the randomness of the tumbling pattern.

It will be understood that two or more toy tumbling assemblies 10 can be set spinning in the horizontal arena 33. Once spinning, the large protrusions 42 on the spinning toy tumbling assemblies 10 will eventually come into contact. The contact may cause a toy tumbling assembly 10 to move out of the horizontal arena 33 and onto the inclined surface 44. Accordingly, toy tumbling assemblies 10 can battle each other on the horizontal arena 33.

Figure 5:
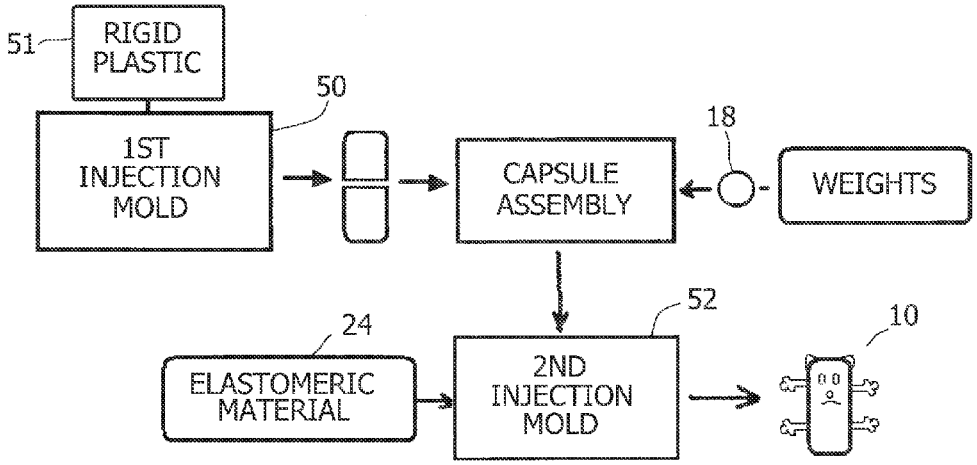
FIG. 5 is a schematic illustrating an exemplary method of manufacture.

Referring to FIG. 5, in conjunction with FIG. 2, it can be seen that in order to manufacture the tumbling toy assembly 10, a plurality of plastic capsules 12 are molded from a rigid plastic 51 using a first injection mold 50. The plastic capsule 12 can be made as a two-part snap-together assembly. In this manner, a large weight 18 can easily be added to each of the capsules 12. Once a weight 18 is added to each plastic capsule 12, the capsule 12 is then placed within a second injection molding machine 52. The outer shell 22 is then molded around the exterior of the plastic capsule 12. Since the elastomeric material 24 has a lower melting point than does the hard plastic of the plastic capsule 12, the internal plastic capsule 12 maintains its shape and structure as the elastomeric material 24 is molded. The elastomeric material 24, however, bonds to the exterior surfaces of the internal plastic capsule 12. This prevents the outer soft shell 22 from being peeled away from the internal plastic capsule 12 by a child. However, it will be understood that the outer shell 22 is merely a secondary molding around the internal plastic capsule 12. As a result, the amount of elastomeric material 24 needed to manufacture each individual tumbling toy assembly is minimized. Since the cost of elastomeric material 24 is generally higher than that of common rigid plastics, it will be understood that the price per piece can be minimized by minimizing the amount of elastomeric material 24 being used and maximizing the size of the inner plastic capsule 12. Preferably, the inner plastic capsule 12 accounts for at least sixty-six percent of the volume of the tumbling toy assembly 10.

Figure 6:
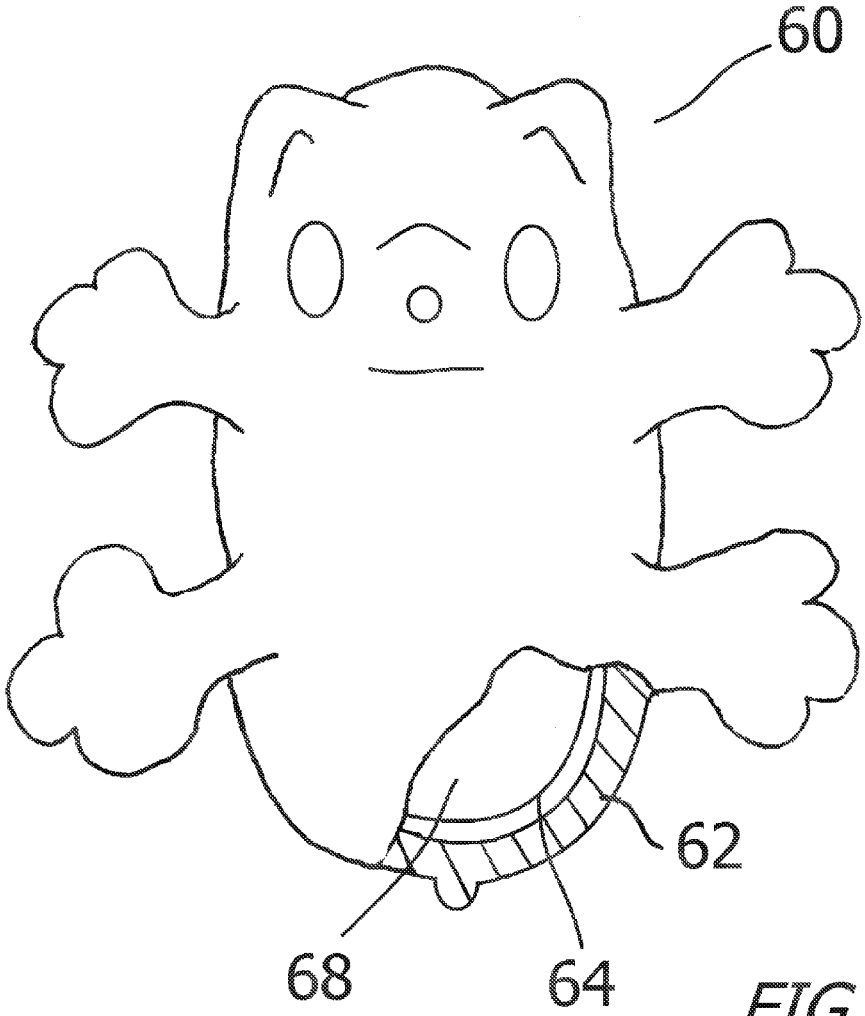
FIG. 6 is a fragmented view of an alternate exemplary embodiment of a toy tumbling assembly.

Referring to FIG. 6, an alternate embodiment of a tumbling toy assembly 60 is illustrated. As can be seen, the tumbling toy assembly 60 is molded from a single plastic material 62. No separate internal capsule is present. Rather, two body halves 63, 65 are molded and are assembled around a weight 68. The two body halves 63, 65 are joined together using either adhesive or a heat weld.

The tumbling toy assembly 60 has extending protrusions 69 that cause the tumbling toy assembly 60 to tumble with the erratic manner previously described in regard to FIG. 4. The tumbling toy assembly 60 also spins in the manner previously described.

Figure 7:
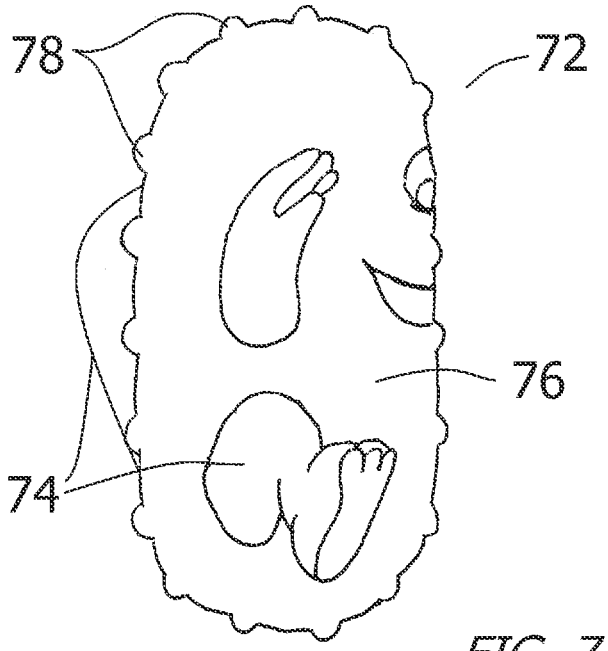
FIG. 7 is a side view of a second alternate embodiment of a toy tumbling assembly with protrusions that extend through more than one plane.

Referring to FIG. 7, another alternate embodiment of a tumbling toy assembly 72 is shown. The tumbling toy assembly 72 has large protrusions 74 that not only extends outwardly from the body 76 of the tumbling toy assembly 72, but also extend forward and/or backward away from the midplane of the toy. The large protrusions 74 are symmetrically disposed about the spin axis 54. In this manner, the tumbling toy assembly 72 remains balanced when spinning.

Furthermore, the entire body 76 of the tumbling toy assembly 72 is covered with small projections 78. In this manner, when the tumbling toy assembly 72 falls forward, it will have different tumbling characteristics than when it tumbles backward. This adds to the randomness of the tumble pattern as the tumbling toy assembly 72 rolls down an inclined surface.

Figure 8:
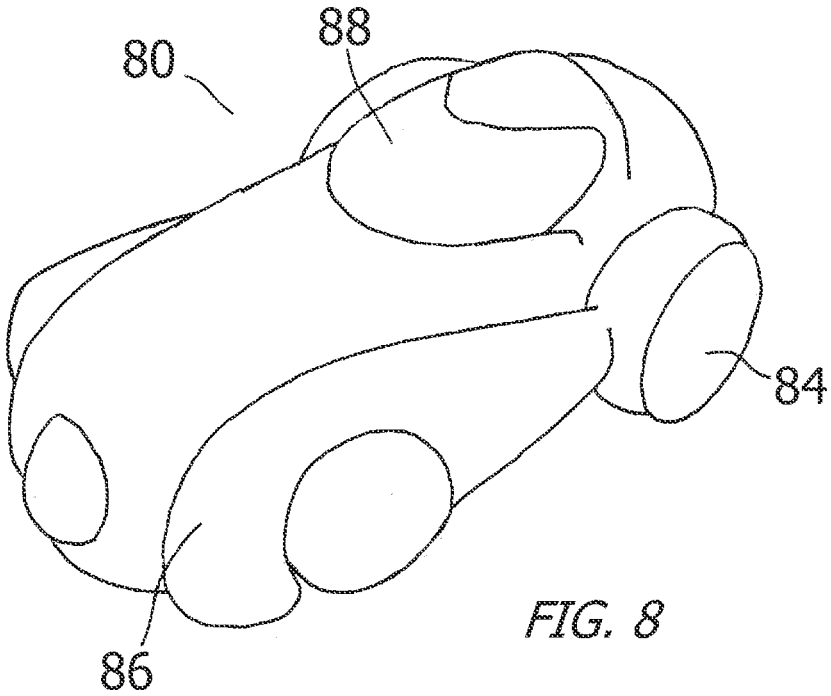
FIG. 8 is a perspective view of a third alternate embodiment of a toy tumbling assembly configured as a toy vehicle.

In all the previous exemplary embodiments of the tumbling toy assembly, the large projections on the tumbling toy assemblies were arms, legs or some other body feature of a creature figure. Referring now to FIG. 8, it will now be understood that this need not be the case. FIG. 8 shows a tumbling toy character configured as an object, such as a vehicle. The tumbling toy assembly 80 has protrusions in the form of wheels 84, fenders 86, windshields 88 and the like. It will therefore be understood that when the tumbling toy assembly 80 tumbles, it follows an erratic tumbling pattern as the various protrusions contact the underlying surface at different times.

It will therefore be understood that the embodiments of the present invention that are illustrated and described are merely exemplary and that a person skilled in the art can make many variations to those embodiments. For instance, the shape of the inner capsule, the protrusions, and the soft shell can be varied in many ways. All such embodiments are intended to be included within the scope of the present invention as defined by the claims.

What is claimed is:

1. A toy assembly, comprising:

a body having a top and a bottom, said body having a connector disposed on said top for applying spin to said body about an imaginary spin axis, and a fulcrum protrusion extending downwardly from said bottom, wherein said fulcrum protrusion is aligned on said imaginary spin axis and said body is balanced about said imaginary spin axis to enable said body to spin in a stable manner upon said fulcrum protrusion, and wherein said body defines an internal weight chamber having a first end and an opposite second end aligned with said imaginary spin axis; and a weight disposed within said weight chamber, wherein said weight is free to move between said first end and said second end of said weight chamber along said imaginary spin axis.

2. The assembly according to claim 1, further including a plurality of protrusions extending outwardly from said body.

3. The assembly according to claim 2, wherein said plurality of protrusions include long protrusions that extend at least one centimeter from said body.

4. The assembly according to claim 3, wherein said long protrusions are arranged in sets of two, wherein each of said long protrusions extends from said shell at a position diametrically opposed about said imaginary spin axis.

5. The assembly according to claim 1, wherein said weight is round and has a predetermined diameter and said weight chamber has a length that is at least two times as long as said predetermined diameter.

6. The assembly according to claim 2, wherein said body includes an inner capsule encased in part by a shell of elastomeric material.

7. The assembly according to claim 6, wherein said fulcrum protrusion is formed as part of said inner capsule.

8. The assembly according to claim 6, wherein said protrusions are molded as part of said shell.

9. A tumbling toy assembly that tumbles down an inclined surface under the force of gravity, said assembly comprising:

a body having a top end and a bottom end;

a spin connector disposed on said top of said body for applying spin to said body;

a weight chamber disposed within said body, said weight chamber having a first end and an opposite second end;

a weight disposed within said weight chamber, wherein said weight is free to move between said first end and said second end of said weight chamber; and protrusions extending outwardly from said body on opposite sides of said body, wherein said protrusions cause said body of said tumbling toy assembly to tumble erratically when said tumbling toy assembly tumbles down an inclined surface.

10. The assembly according to claim 9, wherein said protrusions are molded from elastomeric material.

11. The assembly according to claim 9, wherein said protrusions include long protrusions that extend at least one centimeter from said elastomeric body.

12. The assembly according to claim 9, further including a fulcrum protrusion extending from said bottom end of said body, wherein said fulcrum protrusion is aligned on an imaginary spin axis and said body is balanced about said imaginary spin axis to enable said body to spin in a stable manner upon said fulcrum protrusion.

13. The assembly according to claim 9, wherein said weight is round and has a predetermined diameter and said weight chamber has a length that is at least two times as long as said predetermined diameter.

14. A toy assembly that spins on a flat surface and tumbles down an inclined surface, said assembly comprising:

a body having a top end and a bottom end, said body having a fulcrum protrusion extending downwardly from said bottom, wherein said fulcrum protrusion is aligned on an imaginary spin axis and said body is balanced about said imaginary spin axis to enable said body to spin in a stable manner upon said fulcrum protrusion;

a spin connector disposed on said top of said body for applying spin to said body about said imaginary spin axis;

a weight chamber disposed within said body, said weight chamber having a first end and an opposite second end aligned on said imaginary spin axis and separated by a predetermined distance;

a round weight disposed within said weight chamber, said weight having a diameter that is less than half of said predetermined distance, wherein said weight is free to move between said first end and said second end of said weight chamber.

15. The assembly according to claim 14, further including protrusions extending outwardly from said body on opposite sides of said body, wherein said protrusions cause said body of said tumbling toy assembly to tumble erratically when said tumbling toy assembly tumbles down an inclined surface.

16. The assembly according to claim 15, wherein said protrusions include long protrusions that extend at least one centimeter from said body.

17. The assembly according to claim 16, wherein said protrusions are molded from elastomeric material.

* * * * *